US008045890B2

(12) United States Patent
Kim et al.

(10) Patent No.: US 8,045,890 B2
(45) Date of Patent: Oct. 25, 2011

(54) MULTI-PASS TYPE IMAGE FORMING APPARATUS

(75) Inventors: Hun Sup Kim, Ansan-si (KR); Se-Hyun Lyu, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 603 days.

(21) Appl. No.: 12/039,033

(22) Filed: Feb. 28, 2008

(65) Prior Publication Data

US 2008/0226348 A1 Sep. 18, 2008

(30) Foreign Application Priority Data

Mar. 15, 2007 (KR) ..... 10-2007-0025593

(51) Int. Cl.
*G03G 15/01* (2006.01)

(52) U.S. Cl. ..... 399/226; 399/263

(58) Field of Classification Search ..... 399/222, 399/223, 226, 263
See application file for complete search history.

(56) References Cited

U.S. PATENT DOCUMENTS 4,939,547 A * 7/1990 Miyaji et al. ..... 399/228
6,064,844 A * 5/2000 Isobe et al. ..... 399/119

FOREIGN PATENT DOCUMENTS

KR 10-633097 9/2006

OTHER PUBLICATIONS

KR Office Action issued Apr. 20, 2011 in KR Application No. 10-2007-0025593.

* cited by examiner

*Primary Examiner* — David Gray
*Assistant Examiner* — Barnabas Fekete
(74) *Attorney, Agent, or Firm* — Stanzione & Kim, LLP

(57) ABSTRACT

An image forming apparatus includes a photosensitive body, and a plurality of developing devices to develop a color image on the photosensitive body. The plurality of developing devices include fixed-position developing devices, of which positions relative to the photosensitive body are fixed, and moveable developing devices, of which positions relative to the photosensitive body are changed. Accordingly, the image forming apparatus can be manufactured compactly, by mounting four developing devices, e.g., for yellow, magenta, cyan and black for the color printing such that three developing devices stand by at the respective development positions and one developing device variably moves to the development position so that the photosensitive body is reduced in diameter when compared to a conventional photosensitive body which opposes four developing devices.

13 Claims, 5 Drawing Sheets

MULTI-PASS TYPE IMAGE FORMING APPARATUS

CROSS-REFERENCE TO RELATED APPLICATIONS

This application claims the benefit under 35 U.S.C. 119 (a) of Korean Patent Application No. 2007-0025593, filed on Mar. 15, 2007 in the Korean Intellectual Property Office, the disclosure of which is incorporated herein in its entirety.

BACKGROUND OF THE INVENTION

1. Field of the Invention

The present general inventive concept relates to an image forming apparatus, and more particularly to a multi-pass type image forming apparatus.

2. Description of the Related Art

An image forming apparatus is an apparatus that prints an image on a printing medium, e.g., paper, according to an input image signal. One type of the above-mentioned image forming apparatus, is an electrophotographic color image forming apparatus which is configured such that a laser beam is scanned across a photosensitive body that is charged with a predetermined electric potential to form an electrostatic latent image on the outer peripheral surface of the photosensitive body. The electrostatic latent image is developed into a visible image by supplying a developer (i.e., toner, or toner and carrier) to the electrostatic latent image, and the visible image is then transferred onto and fixed to paper.

Typically, toners of four colors of yellow Y, magenta M, cyan C, and black B are used in the color image forming apparatus, and accordingly four developing devices are needed to adhere the toners of four colors to the electrostatic latent image.

There are two types of image forming apparatuses used when forming a color image. One type of image forming apparatus is a single-pass type in which four developing devices are respectively provided with four photosensitive bodies. The other type of image forming apparatus is a multi-pass type in which four developing devices hold one photosensitive body in common.

One example of the conventional multi-pass type image forming apparatus is disclosed in Korean Patent Registration No. 10-633097. The conventional multi-pass type color image forming apparatus is configured such that the exposure, development and transfer of the respective colors associated with each color toner are repeated on one photosensitive body to overlappingly form a color image on an intermediate transfer medium, and the color image is transferred onto and fixed to paper.

However, the above conventional multi-pass type color image forming apparatus has a problem such that the photosensitive body needs to have a diameter large enough to accommodate all four developing devices to be positioned near the photosensitive body at one time, thereby, placing limitations when manufacturing the image forming apparatus compactly.

SUMMARY OF THE INVENTION

Therefore, the present general inventive concept provides a multi-pass type image forming apparatus having a more compact size by reducing a diameter of a photosensitive body.

Additional aspects and/or utilities of the present general inventive concept will be set forth in part in the description which follows and, in part, will be obvious from the description, or may be learned by practice of the present general inventive concept.

The foregoing and/or other aspects and utilities of the present general inventive concept may be achieved by providing an image forming apparatus including a photosensitive body and a plurality of developing devices to develop a color image on the photosensitive body, the plurality of developing devices including one or more fixed-position developing devices, having positions fixed relative to the photosensitive body, and one or more moveable developing devices, having positions changed relative to the photosensitive body.

The plurality of moving type developing devices may include a linear type developing device which moves linearly, and a rotating type developing device which rotates.

When the rotating type developing device moves away from the photosensitive body, the linear type developing device may move toward the photosensitive body.

The linear type developing device and the rotating type developing device may have a same development position.

The linear type developing device may be provided with a cam member. The linear type developing device may move linearly and reciprocatingly by the cam member.

The rotating type developing device may be provided with an elastic member which elastically biases the rotating type developing device to the development position. When the linear type developing device moves to the development position by the cam member, the linear type developing device may rotate the rotating type developing device away from the photosensitive body, and when the linear type developing device moves away from the photosensitive body, the rotating type developing device may elastically returns to the development position.

The foregoing and/or other aspects and utilities of the present general inventive concept may also be achieved by providing an image forming apparatus including a photosensitive body and a plurality of developing devices to develop a color image on the photosensitive body, the plurality of developing devices including at least one first moving type developing device and at least one second moving type developing device. When the first moving type developing device moves away from a development position on the photosensitive body, the second moving type developing device may move toward the development position on the photosensitive drum.

One of the first moving type developing device and the second moving type developing device may be a linear type developing device which moves linearly to/from the development position, and the other one of the first moving type developing device and the second moving type developing device may be a rotating type developing device which rotates to/from the development position.

The rotating type developing device may be disposed at the outermost position of the plurality of developing devices, the linear type developing device may be disposed adjacent to the rotating type developing device.

The linear type developing device may be provided with a cam member. Additionally, the linear type developing device may move by the cam member.

The rotating type developing device may be provided with an elastic member which elastically biases the rotating type developing device to the development position. When the linear type developing device moves to the development position, the linear type developing device may rotate the rotating type developing device away from the photosensitive body, and when the linear type developing device moves away from the photosensitive body, the rotating type developing device may elastically return to the development position.

The foregoing and/or other aspects and utilities of the present general inventive concept may also provide an image forming apparatus including a photosensitive body and a plurality of developing devices disposed to form a plurality of gap areas with the photosensitive body to supply a plurality of developers to the photosensitive body. A plurality of lines may connect a center of the photosensitive body to centers of the plurality of developing devices may form a plurality of angles with each other, and at least one of the plurality of angles may be different from the other angles.

The plurality of developing devices may include first, second, third and fourth developing devices. The plurality of lines may include first, second, third, and fourth lines to connect the center of the photosensitive body to the first, second, third, and fourth developing devices. The plurality of angles may include first, second, and third angles formed between the first and second, the second and third, and the third and fourth lines, and one of the first, second, and third angles may be different from the other one of the first, second, and third angle.

The plurality of developing devices may include a fixed type developing device and a moving type developing device, and the at least one of the plurality of angles may be an angle formed between the lines of the fixed type developing device and the moving type developing device.

The plurality of developing devices may include a first group of developing devices to move in a linear path with respect to the photosensitive body and a second group of developing devices to move in a non-linear path with respect to the photosensitive body, and the at least one of the plurality of angles may be an angle between lines of the first group of developing devices and the second group of developing devices disposed adjacent to the first group of developing devices.

The angle may be substantially zero between lines of the second group of developing devices.

The foregoing and/or other aspects and utilities of the present general inventive concept may also be achieved by providing an image forming apparatus including a photosensitive body and a plurality of developing devices to develop a color image on a printing medium including a first group of developing devices to move in a non-linear direction with respect to the photosensitive body and a second group of developing devices to move in a linear direction with respect to the first group of developing devices.

The first group of developing devices rotate about a shaft and the second group of developing devices reciprocatingly move in the linear direction.

The first group of developing devices may rotate as a result of the reciprocating movement of the second group of developing devices.

BRIEF DESCRIPTION OF THE DRAWINGS

These and/or other aspects and utilities of the exemplary embodiments according to the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
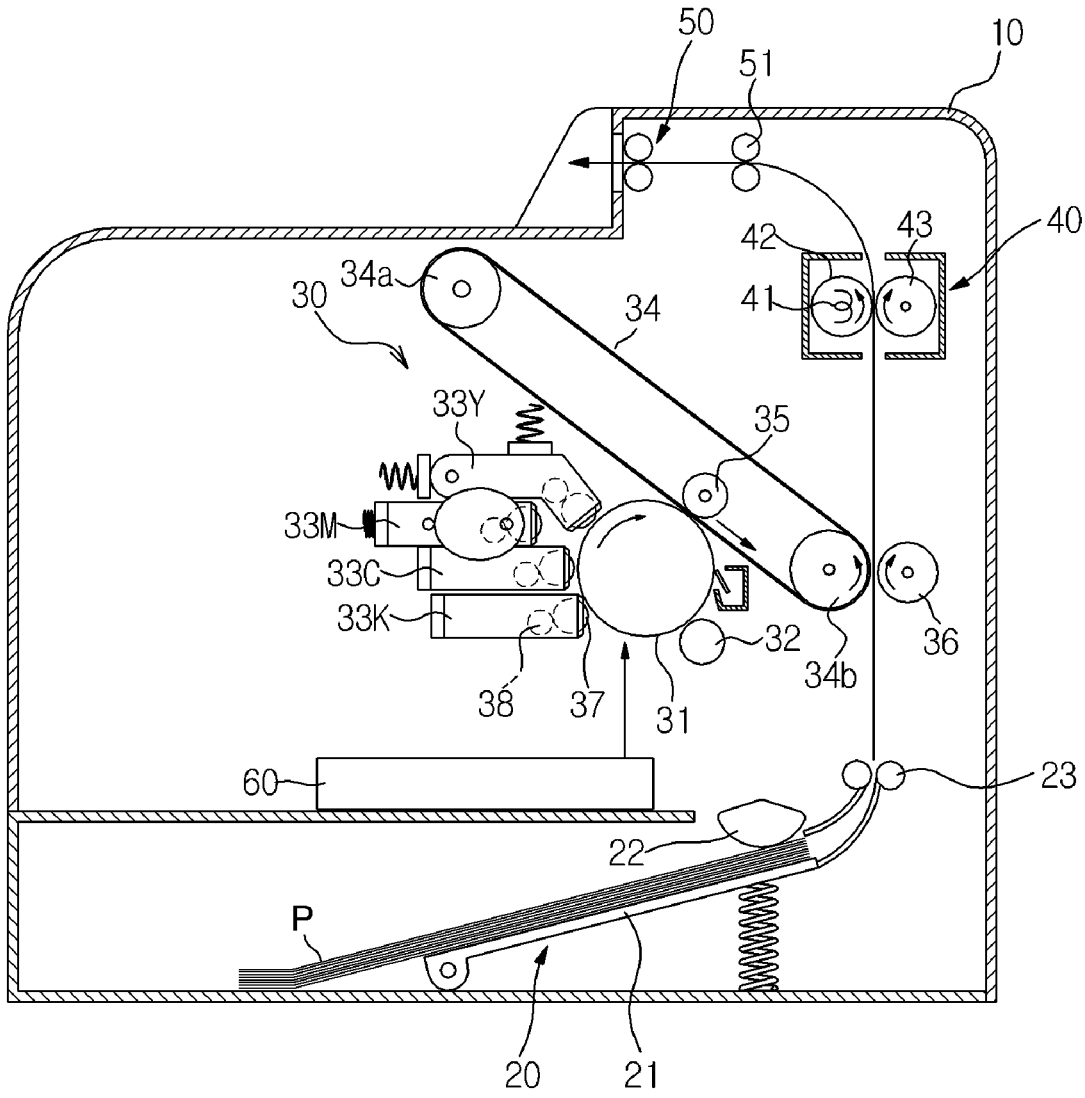
FIG. 1 is a view illustrating a multi-pass type image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

FIG. 1 is a view illustrating schematically an image forming apparatus in accordance with the present general inventive concept. As illustrated in FIG. 1, the image forming apparatus of the present general inventive concept includes a main body 10 which forms an external enclosure to support components mounted therein, a paper supply unit 20 which supplies a printing medium (e.g., paper P), a developing unit 30 which develops an image on the paper P, a fixing unit 40 which fixes the image to the paper P by applying heat and pressure to the paper P, and a paper discharge unit 50 which discharges the paper P with the image fixed thereon to the outside of the main body 10.

The paper supply unit 20 includes a paper tray 21 on which the paper P is stacked, a pickup roller 22 which picks up the paper P that is stacked on the paper tray 21 sheet by sheet, and a feed roller 23 which feeds the picked-up paper P toward the developing unit 30.

The developing unit 30 includes a photosensitive body 31 on which an electrostatic latent image is formed by an exposure unit 60, a charge roller 32 which charges the photosensitive body 31, four developing devices 33Y, 33M, 33C and 33K which develops the electrostatic latent image that is formed on the photosensitive body 31 into a visible image using color toners having the respective colors of yellow Y, magenta M, cyan C, and black K, an intermediate transfer belt 34, a first transfer roller 35, and a second transfer roller 36.

Each of the four developing devices 33Y, 33M, 33C, and 33K include respective developing rollers 37Y, 37M, 37C, and 37K which supply the respective toner from the developing devices 33Y, 33M, 33C, and 33K to the electrostatic latent image that is formed on the photosensitive body 31 to develop the electrostatic latent image. Additionally, each of the developing devices 33Y, 33M, 33C, and 33K have a supply roller 38Y, 38M, 38C, and 38K which each supply the toner from the respective developing devices 33Y, 33M, 33C, and 33K to each of the developing rollers 37Y, 37M, 37C, and 37K by rotating and contacting the developing rollers 37Y, 37M, 37C, and 37K.

The intermediate transfer belt 34 is supported by supporting rollers 34*a* and 34*b*, and turns at the same velocity as a rotational velocity of the photosensitive body 31. The first transfer roller 35 opposes the photosensitive body 31, and transfers the visible image developed on the photosensitive body 31 onto the intermediate transfer belt 34. The second transfer roller 36 opposes the intermediate transfer belt 34. While the visible image is transferred onto the intermediate transfer belt 34 from the photosensitive body 31, the second transfer roller 36 is spaced apart from the intermediate transfer belt 34. When the visible image is completely transferred onto the intermediate transfer belt 34, the second transfer roller 36 comes into contact with the intermediate transfer belt 34 with a prescribed pressure.

The fixing unit 40 fixes the visible image to the paper P by applying heat and pressure to the paper P. Specifically, the fixing unit 40 includes a heat roller 42 which has a heat source 41, to heat the paper P with the toner as it passes through the fixing unit and a press roller 43, which is disposed opposite to the heat roller 42, that maintains a constant fixing pressure with the heat roller 42.

The paper discharge unit 50 includes discharge rollers 51 which are sequentially mounted so as to discharge the paper P having passed through the fixing unit 40 to the outside of the main body 10.

Figure 2:
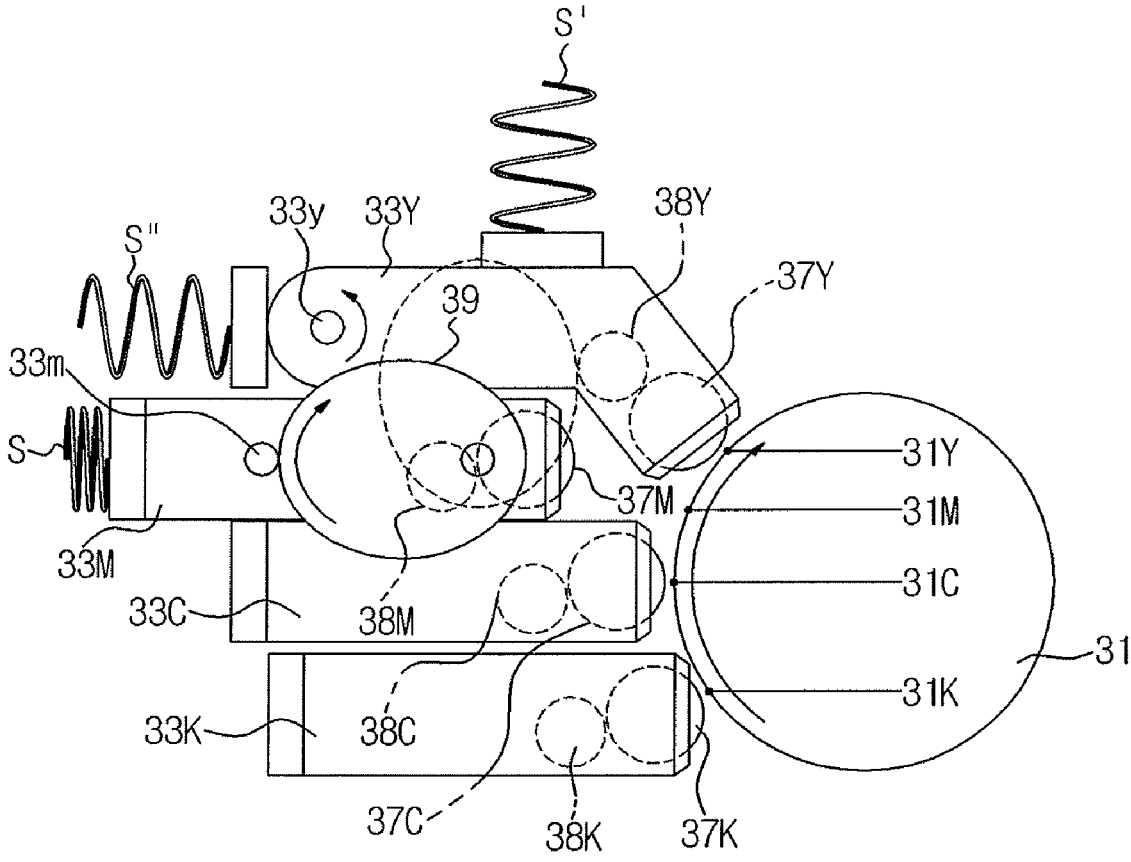
FIGS. 2 and 3 are views illustrating schematically a developing unit of a multi-pass type image forming apparatus in accordance with an exemplary embodiment of the present general inventive concept.
Figure 3:
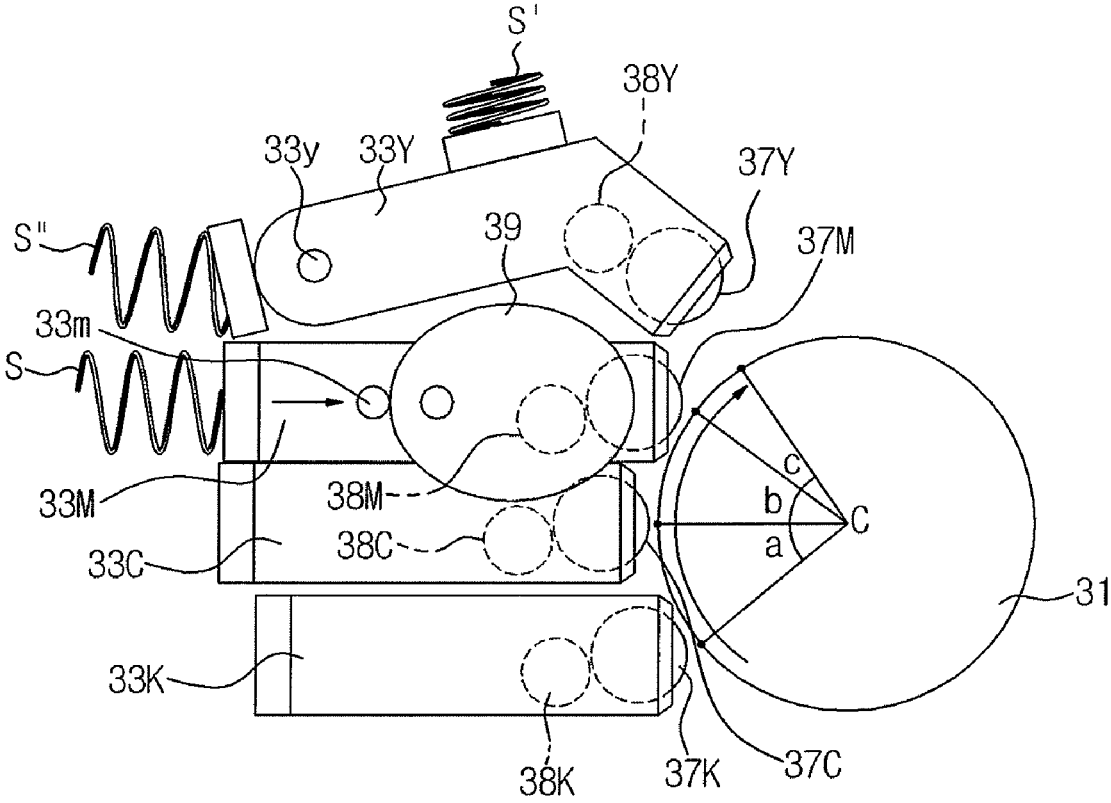

FIGS. 2 and 3 are views illustrating schematically the developing unit 30 of the image forming apparatus in accordance with an exemplary embodiment of the present general inventive concept.

Referring to FIGS. 2 and 3, as described above, the image forming apparatus according to the present general inventive concept includes four developing devices 33Y, 33M, 33C and 33K to form the color toner images of yellow, magenta, cyan, and black. Two of the developing devices 33Y and 33M are referred to as moving type developing devices, wherein the position of the respective developing rollers 37Y and 37M are changed or adjusted with respect to the photosensitive body 31. The remaining two devices, 33C and 33K, are fixed-position developing devices, wherein the position of the respective developing rollers 37Y and 37M, are fixed with respect to the photosensitive body 31. Because the functionality of fixed-position developing devices are well known in the art, a detailed description of the fixing type developing devices 33C and 33K will be omitted herein.

The moving type developing device 33M is a linear type developing device which moves in a linear direction The moving type developing device 33Y is a rotating type developing device that rotates in a non-linear direction. When the developing devices for yellow 33Y, magenta 33M, cyan 33C and black 33K are arranged in order from top to bottom, the developing device 33Y for yellow is disposed at the uppermost position and is referred to as a rotating type developing device, and the developing device 33M for magenta is disposed beneath the developing device 33Y for yellow and is referred to as the linear type developing device. Additionally, if the developing device 33K for black is referred to as the rotating type developing device, the developing device 33C for cyan is referred to as the linear type developing device.

The rotating type developing device 33Y for yellow and the linear type developing device 33M for magenta perform the development function at the same position on the photosensitive body 31. Therefore, when the rotating type developing device 33Y is located near the photosensitive body 31, the linear type developing device 33M is located away from the photosensitive body 31. Alternatively, when the rotating type developing device 33Y is located away from the photosensitive body 31, the linear type developing device 33M approaches the photosensitive body 31.

The linear type developing device 33M moves linearly via a driving force of a driving unit 39 which is provided in the main body 10, and the rotating type developing device 33Y rotates via the forward/backward movement of the linear type developing device 33M. In other words, as the linear type developing 33M moves back and forth, the back and forth movement causes the rotating type development device 33Y to turn.

As illustrated in FIGS. 2-3, if the driving unit 39 is configured as a cam member 39, the linear type developing device 33M is provided with a protrusion 33*m* and a backup spring s. Thus, when the cam member 39 rotates, the protrusion 33*m* moves along the outer periphery of the cam member 39 while being supported by the backup spring s. Thus, the linear type developing device 33M has a reciprocating movement.

As the linear type developing device 33M moves forward and backward, the rotating type developing device 33Y rotates on a rotating shaft 33*y*. The rotating type developing device 33Y is provided with backup springs S' and S" which elastically bias the rotating type developing device 33Y to the development position (i.e., the position wherein the developing roller 37Y approaches and/or contacts the photosensitive body 31). When the linear type developing device 33M moves forward (i.e. approaches the photosensitive body), the rotating type developing device 33Y rotates away from photosensitive body 31. Alternatively, when the linear type developing device 33M moves backward (i.e., away from the photosensitive body 31), the rotating type developing device 33Y elastically returns to its original position and approaches the photosensitive body 31.

As described above with reference to FIG. 2, since the photosensitive body 31 in this embodiment opposes three developing devices 33Y, 33C, and 33K in a normal development state (i.e., the state wherein the three development devices 33Y, 33C, and 33K are at rest in the development position), the photosensitive body 31 can be reduced in diameter when compared to a conventional photosensitive body which opposes four developing devices.

Although it has been shown and described that the linear reciprocating movement of the linear type developing device 33Y is achieved by the cam member 39, it would be appreciated by those skilled in the art that changes and modifications may be made in this embodiment, for example, using a rack and pinion device, etc.

Referring to FIGS. 2 and 3, center portions 31K, 31C, 31M, and 31Y of gap areas (i.e., development positions) through which respective developers are transferred from the respective developing devices 33Y, 33M, 33C, and 33K to the photosensitive body 31, are formed around an outer periphery or on the surface of the photosensitive body 31. Lines that connect a rotating center C of the photosensitive body 31 and the respective center portions 31Y, 31M, 31C, and 31K, form a first angle a, second angle b, and third angle c, respectively. Since angle c is smaller than angles a and b, the gap areas of the developing devices 37Y and 37M with the photosensitive body 31 may overlap, however, the gap areas of the developing devices 37C and 37K with the photosensitive body 31 may not overlap. The angle c may also be greater than angles a and b, or may be a zero degree angle when the gap areas of 31Y, 31M, 31C, and 31K completely overlap. Additionally, angle b may be greater than angle c, but smaller than angle a.

Developing device 33M moves linearly with respect to developing devices 33K and 33C, and developing device 33Y does not move linearly but rotates with respect to developing devices 33C and 33K. In other words, developing device 33M moves along a linear path toward the photosensitive body 31 and developing device 33Y moves along a non-linear path towards photosensitive body 31.

Hereinafter, the operation of the multi-pass type image forming apparatus according to an embodiment of the present general inventive concept as structured above will be described below.

If a print command is input, the exposure unit 60 scans a beam corresponding to the desired color image information as identified in the print command, across the photosensitive body 31. The photosensitive body 31 is in turn charged with a uniform electric potential by the charge roller 32. The color toner images that correspond to the color image information sent by the print command are developed on the photosensitive body 31 by the respective developing devices 33Y, 33M, 33C, or 33K. For instance, if the electrostatic latent image of yellow is formed on the photosensitive body 31, voltage is applied to the developing roller 37Y of the developing device 33Y for yellow, and the yellow toner is adhered to the electrostatic latent image of the photosensitive body 31 by a voltage difference. The yellow toner image is then transferred onto the intermediate transfer belt 34 by the first transfer roller 35. If the yellow toner image corresponding to one sheet of paper P is completely transferred, the magenta, cyan, and black toner images are also transferred onto the intermediate transfer belt 34 through the same procedures as set out above. The toner images of the respective colors are overlapped on the intermediate transfer belt 34, and accordingly the overlapped images form a visible color image that is transferred onto the paper P as it passes between the intermediate transfer belt 34 and the second transfer roller 36. The image that is transferred onto the paper is then fixed to the paper P after passing through the fixing unit 40. After the paper P passes through the fixing unit 40, it is discharged outside the main body 10, by the discharge rollers 51.

The operation of the rotating type developing device 33Y and the linear type developing device 33M will now be described in further detail with reference to FIGS. 2 and 3. If the electrostatic latent image formed on the photosensitive body 31 is developed by the toner contained in the rotating type developing device 33Y for yellow, the cam member 39 will begin rotating in order to move the linear type developing device 33M for magenta towards the photosensitive body 31. The rotating type developing device 33Y for yellow is simultaneously pushed and rotated away from the photosensitive body 31 by the reciprocating motion of the linear type developing device 33M for magenta as the developing device 33M moves toward the photosensitive body 31. The linear type developing device 33M for magenta stops at the development position in order to develop the electrostatic latent image formed on the photosensitive body 31 using the magenta toner.

Figure 4:
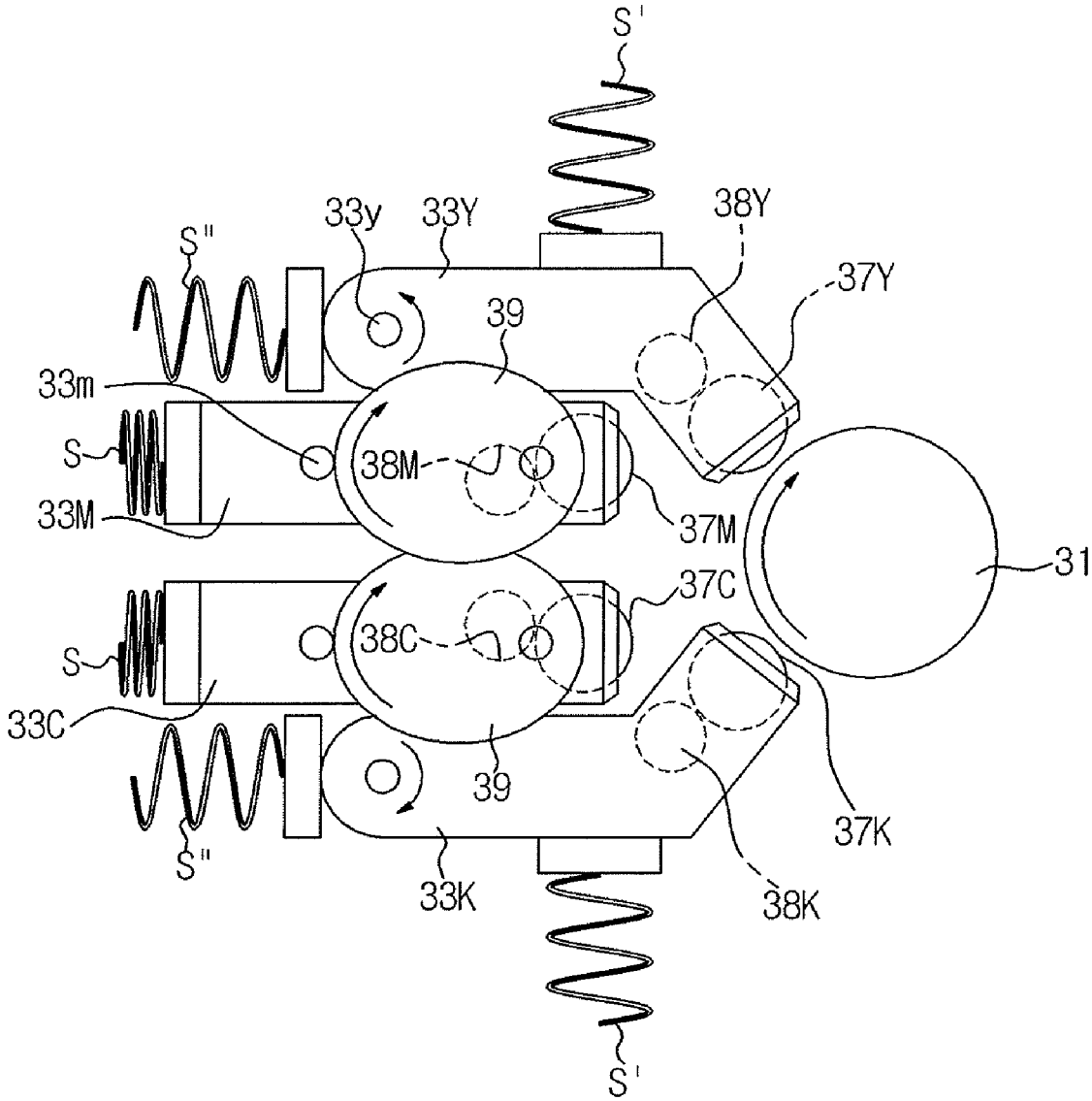
FIGS. 4 and 5 are views illustrating schematically a developing unit of a multi-pass type image forming apparatus in accordance with another exemplary embodiment of the present general inventive concept.
Figure 5:
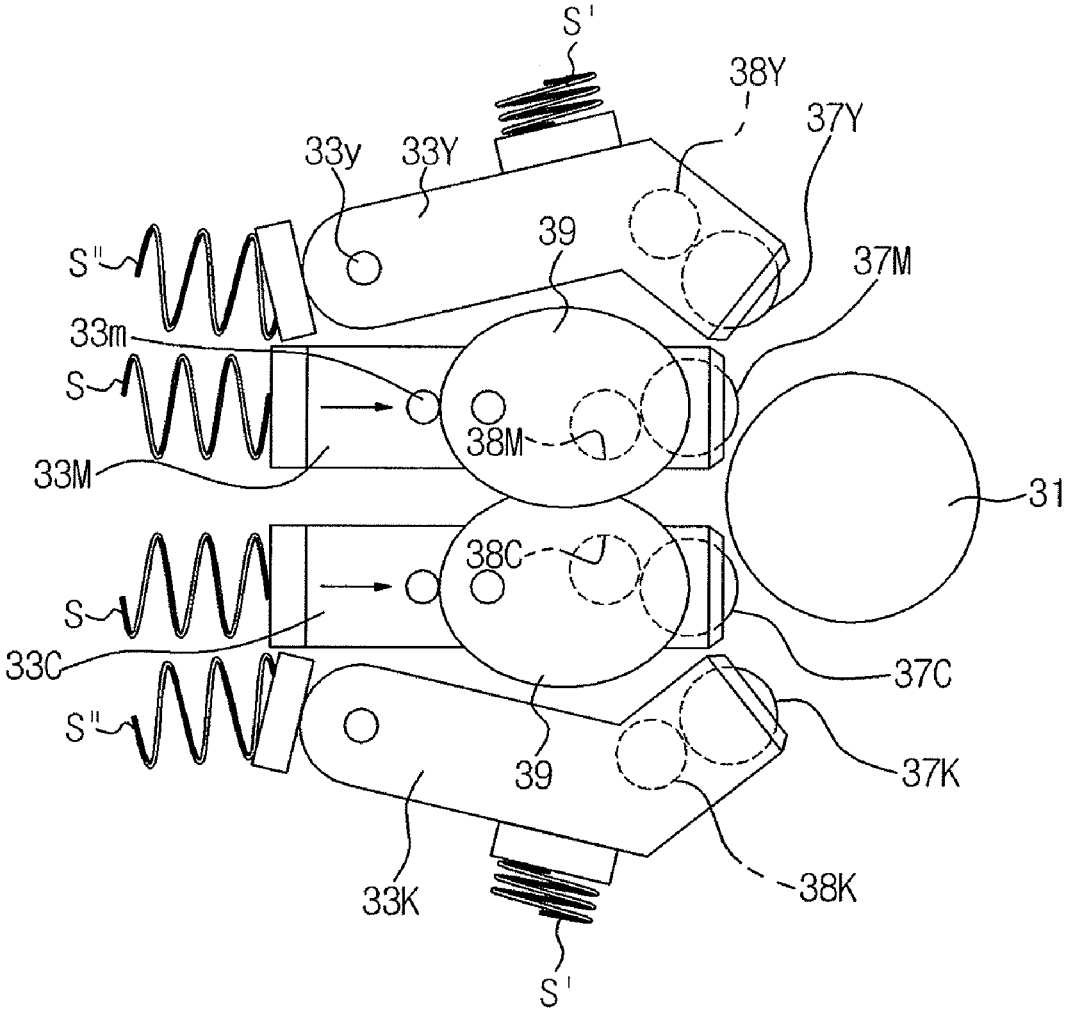

FIGS. 4 and 5 are views illustrating schematically the developing unit of the multi-pass type image forming apparatus in accordance with another exemplary embodiment of the present general inventive concept. In this embodiment, all the developing devices 33Y, 33M, 33C, and 33K for yellow, magenta, cyan and black are configured as moving type developing devices. For instance, the developing device 33Y for yellow disposed at the uppermost position and the developing device 33K for black disposed at the lowermost position are the rotating type developing devices. The developing device 33M for magenta and the developing device 33C for cyan disposed between the developing device 33Y for yellow and the developing device 33K for black are the linear type developing devices. Since the photosensitive body 31 in this embodiment opposes two developing devices in a normal development state, the photosensitive body 31 can be reduced even further in diameter, as compared to the embodiments illustrated in FIGS. 2-3. The embodiments as illustrated in FIGS. 4-5 will be discussed in further detail below.

The developing devices 33Y and 33M will be referred to herein as developing devices of a first group and developing devices 33C and 33K will be referred as developing devices of a second group. Each of the developing devices 33Y and 33M of the first group are referred to as moving type devices, wherein the position of the respective developing rollers, 37Y and 37M, are changed or adjusted with respect to the photosensitive body 31. Additionally, each of the developing devices of the first group moves in opposing directions, depending upon a given print command. Specifically, as the developing device 33M reciprocatingly moves in a linear direction, development device 33Y simultaneously moves about shaft 33*y* in an opposing, non-linear direction. For instance, development device 33Y is elastically biased via springs S' and S" in the development position (i.e., the position wherein the development roller 37Y approaches and/or contacts the photosensitive body 31). However, when development device 33M moves linearly forward, developing device 33Y simultaneously turns about shaft 33*y* thereby moving in a non-linear direction such that the developing device 33Y and its respective developing roller 37Y move away from photosensitive device 31. Alternatively, as developing device 33M moves linearly backward, developing device 33Y returns to the development position whereby the development roller 37Y again approaches and/or contacts the photosensitive body 31.

Developing device 33M moves linearly via a driving force of a driving unit 39 which is provided in the main body 10. Additionally, developing device 33Y moves via the moving force of developing device 33M.

As illustrated in FIGS. 4-5, if the driving unit 39 is configured as a cam member 39, developing device 33M is provided with a protrusion 33*m* and a backup spring S. Thus, when the cam member 39 rotates, the protrusion 33*m* moves along the outer periphery of the cam member 39 while being supported by backup spring S, thereby allowing the recriprocating movement of developing device 33M.

Similarly, the developing devices of a second group operate in the same manner as discussed above with respect to the developing devices of a first group. In particular, developing unit 33K is elastically biased via springs S' and S" in the development position. However, when development device 33C moves linearly forward, developing device 33K simultaneously turns about shaft 33*k* thereby moving in a non-linear direction such that the developing device 33K and its respective developing roller 37K move away from photosensitive device 31. Alternatively, as developing device 33C moves linearly backward, developing device 33K returns to the development position whereby the developing device 33K and development roller 37K again approaches and/or contacts the photosensitive body 31.

Developing device 33M moves linearly via a driving force of a driving unit 39 which is provided in the main body 10. Additionally, developing device 33Y rotates via the moving force of developing device 33M.

Developing device 33M is further provided with a protrusion 33*m* and a backup spring S Thus, when the cam member 39 rotates, the protrusion 33*m* moves along the outer periphery of the cam member 39 while being supported by backup spring S, thereby allowing the reciprocating movement of developing device 33M. The driving unit 39 is not limited to a cam member and any driving unit may be utilized to actuate the development units.

Thus, it is apparent from the above description, the multi-pass type image forming apparatus according to the present general inventive concept can be manufactured having a compact size, by mounting four developing devices 33Y, 33M, 33C, and 33K for yellow, magenta, cyan and black for color printing such that three developing devices rest at the respective development positions and one developing device variably moves to the development position so that the photosensitive body 31 is reduced in diameter as compared to a conventional photosensitive body which opposes four developing devices. Further in an alternate embodiment according to the present general inventive concept, the multi-pass image forming apparatus can be manufactured such that two developing devices rest at the respective development positions whereby two developing devices also move in opposing directions with respect to the other developing devices.

Although embodiments of the present general inventive concept have been shown and described, it would be appreciated by those skilled in the art that changes may be made in the above described embodiments without departing from the principles and spirit of the general inventive concept, the scope of which is defined in the claims and their equivalents.

What is claimed is:

1. An image forming apparatus including a photosensitive body and a plurality of developing devices to develop a color image on the photosensitive body, the plurality of developing devices comprising:

one or more first developing devices disposed in the image forming apparatus at fixed positions relative to the photosensitive body, and one or more second developing devices having positions changing relative to the photosensitive body, wherein the second developing devices include a linear developing device which moves in a linear direction, and a rotating developing device which rotates.

2. The image forming apparatus according to claim 1, wherein when the rotating developing device moves away from the photosensitive body, the linear developing device moves toward the photosensitive body.

3. The image forming apparatus according to claim 2, wherein the linear developing device and the rotating developing device have a same development position on the photosensitive body.

4. The image forming apparatus according to claim 1, wherein the linear developing device is provided with a cam member, and wherein the linear developing device moves linearly reciprocatingly by the cam member.

5. The image forming apparatus according to claim 4, wherein the rotating developing device is provided with an elastic member which elastically biases the rotating developing device to the development position, when the linear developing device moves to the development position by the cam member, the linear type developing device rotates the rotating developing device away from the photosensitive body, and when the linear developing device moves away from the photosensitive body, the rotating developing device elastically returns to the development position.

6. An image forming apparatus including a photosensitive body and a plurality of developing devices to develop a color image on the photosensitive body, comprising:

at least one fixed-position developing device; and at least one first moving developing device and at least one second moving developing device, wherein when the first moving developing device moves away from a development position on the photosensitive body, the second moving developing device moves to the development position, and wherein one of the first moving developing device and the second moving developing device is a linear developing device that moves linearly to/from the development position, and the other one of the first moving developing device and the second moving developing device is a rotating developing device which rotates to/from the development position.

7. The image forming apparatus according to claim 6, wherein the rotating developing device is disposed at the outermost position of the plurality of developing devices, and the linear developing device is disposed adjacent to the rotating type developing device.

8. The image forming apparatus according to claim 6, wherein the linear developing device is provided with a cam member, wherein the linear developing device moves by the cam member.

9. The image forming apparatus according to claim 6, wherein the rotating developing device is provided with an elastic member which elastically biases the rotating developing device to the development position, wherein when the linear developing device moves to the development position, the linear developing device rotates the rotating developing device away from the photosensitive body, and when the linear developing device moves away from the photosensitive body, the rotating developing device elastically returns to the development position.

10. An image forming apparatus including a photosensitive body and a plurality of developing devices to develop a color image on the photosensitive body comprising:

one or more fixed-position developing devices that have fixed positions relative to the photosensitive body; and a plurality of moveable developing devices that change position relative to the photosensitive body, the plurality of moveable developing devices comprising:

at least one first developing device and at least one second developing device, wherein when the first developing device moves away from a development position on the photosensitive body, the second developing device moves to the development position, and wherein at least one of the first developing device and the second developing device is a linear developing device which moves in a linear direction, and at least the other one of the first developing device and the second developing device is a rotating developing device which rotates.

11. The image forming apparatus of claim 10, wherein the development positions are formed about a surface of the photosensitive body and have a plurality of portions at predetermined positions to receive respective developing rollers of the respective plurality of developing devices.

12. An image forming apparatus comprising:

a photosensitive body; and a plurality of developing devices disposed to form a plurality of gap areas with the photosensitive body to supply a plurality of developers to the photosensitive body, wherein a plurality of lines that connect a first predetermined position on the photosensitive body to second predetermined positions on the plurality of developing devices form a plurality of angles with each other, and at least one of the plurality of angles is different from the other angles, wherein the plurality of developing devices comprise a fixed-position developing device and a plurality of moveable developing devices, and where the at least one of the plurality of angles is an angle between the lines of the fixed-position developing device and at least one of the plurality of moveable developing devices, wherein one of the plurality of moving developing devices is a linear developing device that moves linearly to/from a development position, and another one of the plurality of moving developing devices is a rotating developing device which rotates to/from the development position.

13. The forming apparatus of claim 12, wherein:

the plurality of developing devices comprise first, second, third and fourth developing devices;

the plurality of lines comprise first, second, third, and fourth lines to connect the first predetermined position on the photosensitive body to the first, second, third, and fourth developing devices;

the plurality of angles comprise first, second, and third angles formed between the first and second, the second and third, and the third and fourth lines; and one of the first, second, and third angles are different from the other one of the first, second, and third angle.

* * * * *